US009327163B2

(12) United States Patent
Lin

(10) Patent No.: US 9,327,163 B2
(45) Date of Patent: May 3, 2016

(54) SWINGABLE EXERCISE BIKE

(71) Applicant: BH Asia Ltd., Taichung (TW)

(72) Inventor: Fu-Hai Lin, Taichung (TW)

(73) Assignee: BH Asia Ltd., Taichung (TW)

( * ) Notice: Subject to any disclaimer, the term of this patent is extended or adjusted under 35 U.S.C. 154(b) by 166 days.

(21) Appl. No.: 14/287,149

(22) Filed: May 26, 2014

(65) Prior Publication Data

US 2015/0111704 A1 Apr. 23, 2015

(30) Foreign Application Priority Data

Oct. 22, 2013 (TW) ..... 102219633 U

(51) Int. Cl.
*A63B 21/00* (2006.01)
*A63B 22/06* (2006.01)

(52) U.S. Cl.
CPC ..... *A63B 22/0605* (2013.01)

(58) Field of Classification Search
CPC ..... A63B 21/00
USPC ..... 482/57, 142, 60, 61
See application file for complete search history.

(56) References Cited

U.S. PATENT DOCUMENTS

2014/0087932 A1* 3/2014 Ito ..... B65H 27/00 492/59
2014/0148321 A1* 5/2014 Hatano ..... B65H 5/228 493/56

FOREIGN PATENT DOCUMENTS

TW M314622 U 7/2007

* cited by examiner

*Primary Examiner* — Jerome W Donnelly
(74) *Attorney, Agent, or Firm* — Alan D. Kamrath; Kamrath IP Lawfirm, P.A.

(57) ABSTRACT

A swingable exercise bike includes a base, a bike body and multiple cushion units. The base has two horizontal tubes. The bike body is pivotally connected with the base and has a bike frame and two swinging seats. The swinging seats are respectively securely mounted on a front end and a rear end of the bike frame. The cushion units are elastic and are mounted between the horizontal tubes and the swinging seats, each cushion unit having a fixed end and a free end opposite to the fixed end. The cushion units can help the bike body simulate a situation of riding a real bike, and provides fun and variations during exercising.

15 Claims, 7 Drawing Sheets

SWINGABLE EXERCISE BIKE

BACKGROUND OF THE INVENTION

1. Field of the Invention

The present invention relates to an indoor exercise equipment, and more particularly to a swingable exercise bike.

2. Description of Related Art

A conventional exercise bike is used in exercise and simulates riding a real bike to train the muscle of the legs, to strengthen functions of the heart and the lung, and to improve the blood circulations. The conventional exercise bike has shortcomings such as being monotonous and lack of entertaining effects, all of which cause people to give up exercise easily.

TW patent No M314622 discloses a swinging exercise bike that solves the shortcomings of the conventional exercise bike. With reference to FIGS. 6 and 7, the swinging exercise bike includes a base 70 for being placed on floor, a bike body 80 mounted on the base 70, and a swinging apparatus 90 mounted on the base 70 and connected with the bike body 80. The swinging apparatus 90 provides a right-left swinging movement for the bike body 80 to resolve the shortcomings of being monotonous.

The structure of the bike body 80 is similar to an ordinary exercise bike and has a handlebar 81, a seat 82, two pedals 83 and a flywheel 84.

The swinging apparatus 90 has a base frame 91, a swinging seat 92, a pivot shaft 93 and two cushion apparatuses 94. The base frame 91 is mounted on the base 70 and has a movable device 911 that is a telescopic tube assembly. The swinging seat 92 is securely mounted on the bike body 80. The movable device 911 provides a movement function for the swinging seat 92 to move up and down. The pivot shaft 93 pivotally connects the swinging seat 92 with the movable device 911 of the base frame 91. The cushion apparatuses 94 are sloped, are mounted on the base frame 91, are respectively located at two sides of the movable device 911, and each cushion apparatus 94 has a shock absorber 941 and a spring 942 mounted around the shock absorber 941.

With reference to FIG. 7, the swinging apparatus 90 has a complicated design and is difficult to assemble and install, and hence the cost of the swinging apparatus 90 is high. Additionally, the swinging apparatus 90 has a critical shortcoming that the movement of the swinging seat 92 is restricted by the shock absorbers 941 of the cushion apparatuses 94, and thus the ends of the swinging seat 92 cannot swing when a user rides on the bike body 80. Therefore, the swinging apparatus 90 cannot provide a wide swinging range when using the shock absorber 941 as a cushion component.

To overcome the shortcomings of the conventional exercise bike, the present invention provides a swingable exercise bike to mitigate or obviate the aforementioned problems.

SUMMARY OF THE INVENTION

The main objective of the invention is to provide a swingable exercise bike. The swingable exercise bike includes a base, a bike body and multiple cushion units. The base has two horizontal tubes. The bike body is pivotally connected with the base and has a bike frame and two swinging seats. The swinging seats are respectively securely mounted on a front end and a rear end of the bike frame. The cushion units are elastic and are mounted between the horizontal tubes and the swinging seats, each cushion unit having a fixed end and a free end opposite to the fixed end.

Other objects, advantages, and novel features of the invention will become more apparent from the following detailed description when taken in conjunction with the accompanying drawing.

DETAILED DESCRIPTION OF PREFERRED EMBODIMENT

Figure 1:
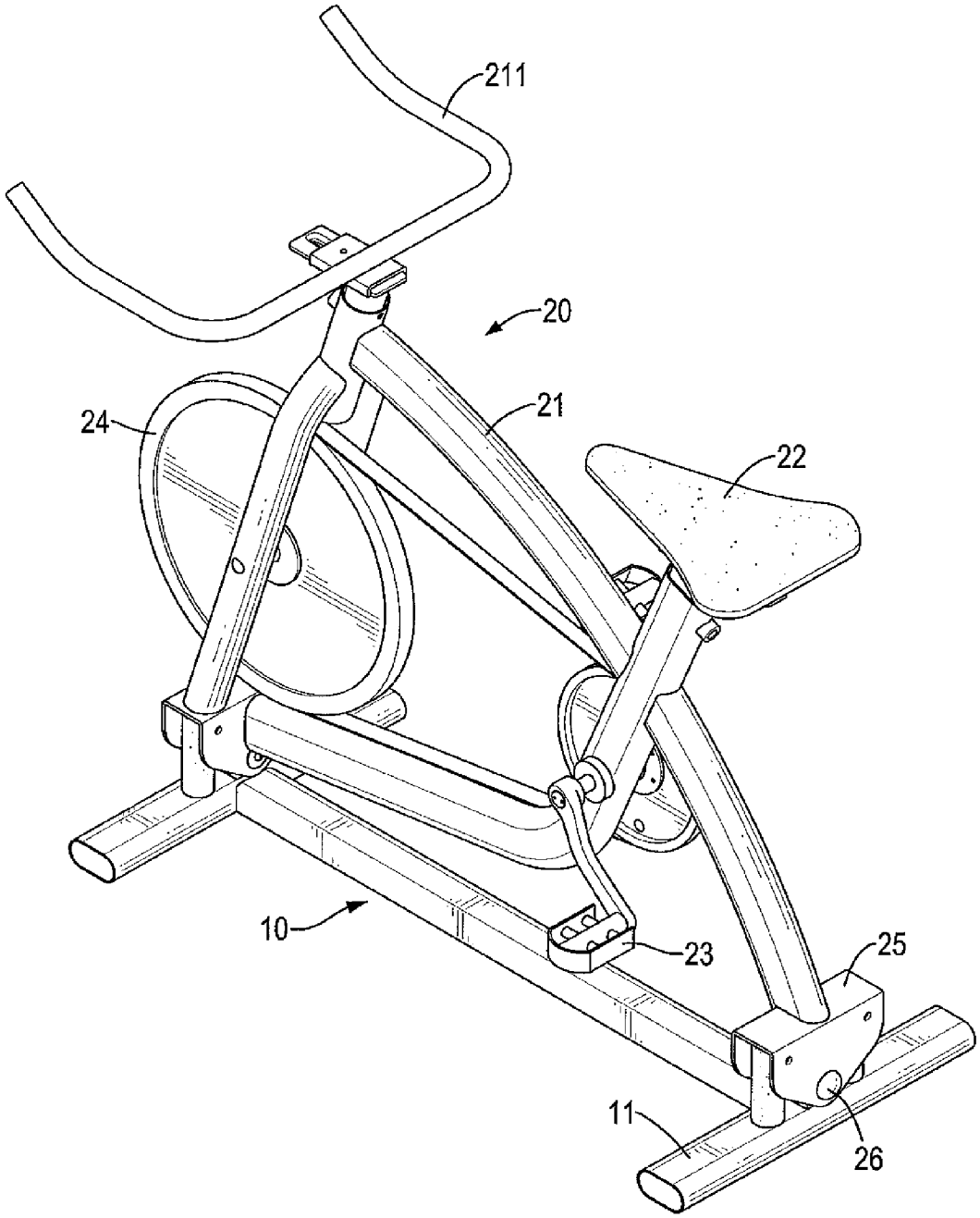
FIG. 1 is a perspective view of a first embodiment of a swingable exercise bike in accordance with the present invention.
Figure 2:
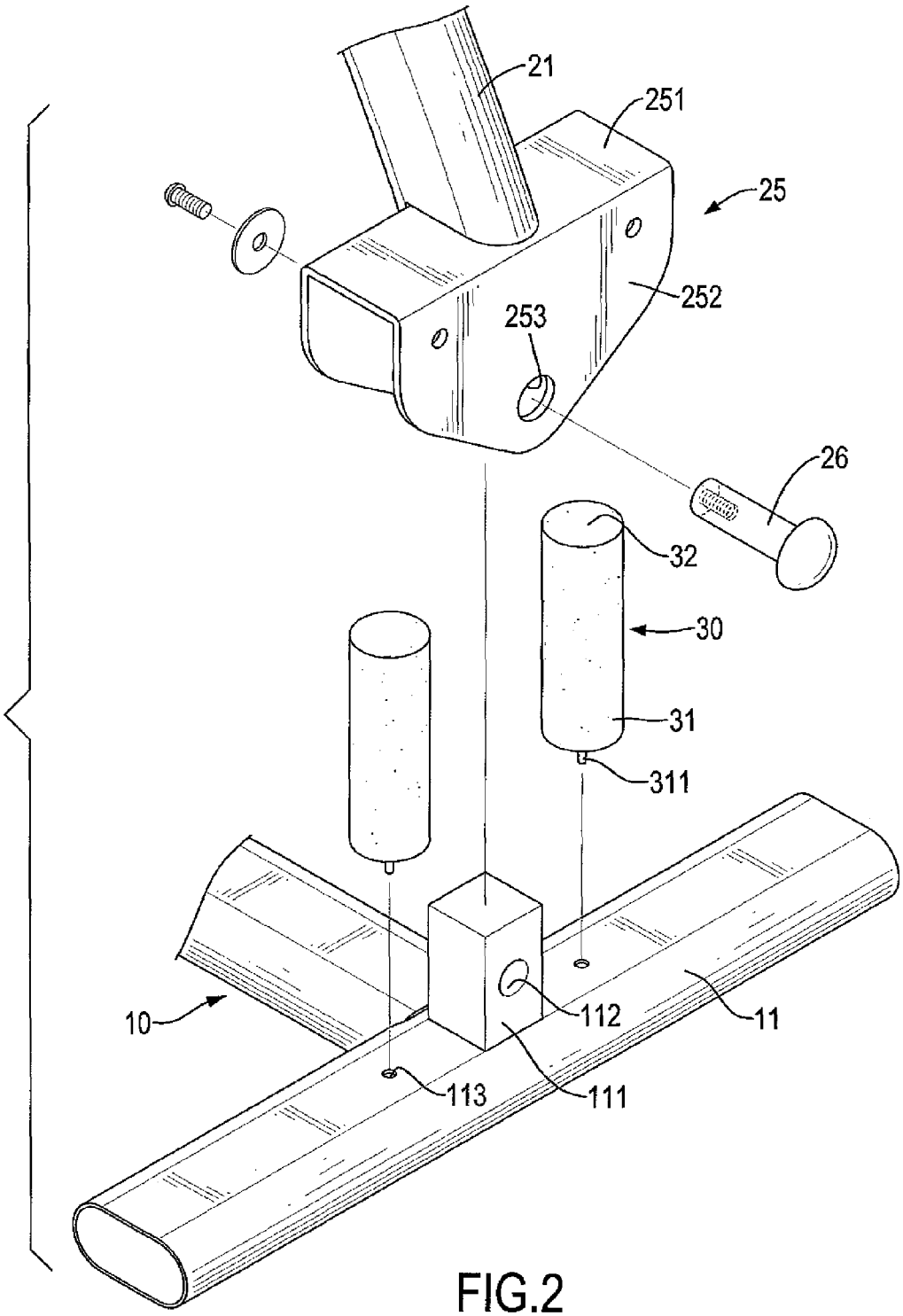
FIG. 2 is an enlarged exploded perspective view of the swingable exercise bike in FIG. 1.

With reference to FIGS. 1 and 2, a first preferred embodiment of a swingable exercise bike includes a base 10, a bike body 20 and multiple cushion units 30.

The base 10 is H-shaped, is horizontally placed on floor as a firm and stable support, and has two horizontal tubes 11 parallel with each other. Each horizontal tube 11 has a supporting rod 111, a pivot hole 112 and two cushion holes 113. The supporting rod 111 is formed on the horizontal tube 11 and is located at a center of the horizontal tube 11. The pivot hole 112 is formed through the supporting rod 111. The cushion holes 113 are formed in the horizontal tube 11 and are respectively located at two sides of the supporting rod 111.

The bike body 20 is mounted on the base 10 and has a bike frame 21, a seat 22, two pedals 23, a flywheel 24, two swinging seats 25 and two pivot shafts 26. The type and the design of the base 10 and the bike body 20 may be conventional. The bike frame 21 is assembled by metal tubes and has a front end, a rear end, and a handlebar 211. The handlebar 211 is mounted on a top of the front end of the bike frame 21 for the user to grip the handlebar 211. The seat 22 is mounted on a middle section of the bike frame 21. The pedals 23 are respectively mounted on two sides of the bike frame 21 and are located adjacent to a bottom section of the bike frame 21. The flywheel 24 is mounted on the bottom section of the bike frame 21, is connected with the pedals 23 and is driven by the pedals 23. When a user treads the pedals 23, the flywheel 24 provides damping or inertia for assist in the riding exercise.

The swinging seats 25 are U-shaped in cross section, and are respectively securely mounted on the front end and the rear end of the bike frame 21. Each swinging seat has a seat board 251, two supporting plates 252 and two through holes 253. The seat board 251 is rectangular and is horizontally mounted on the bike body 20. The supporting plates 252 parallelly and respectively protrude downward from two horizontal edges of the seat board 251. The through holes 253 are respectively mounted through the supporting plates 252 and are aligned with the pivot hole 112.

The pivot shaft 26 is mounted through the through holes 253 and the pivot hole 112 to pivotally connect the swinging seat 25 with the supporting rod 111.

Figure 3:
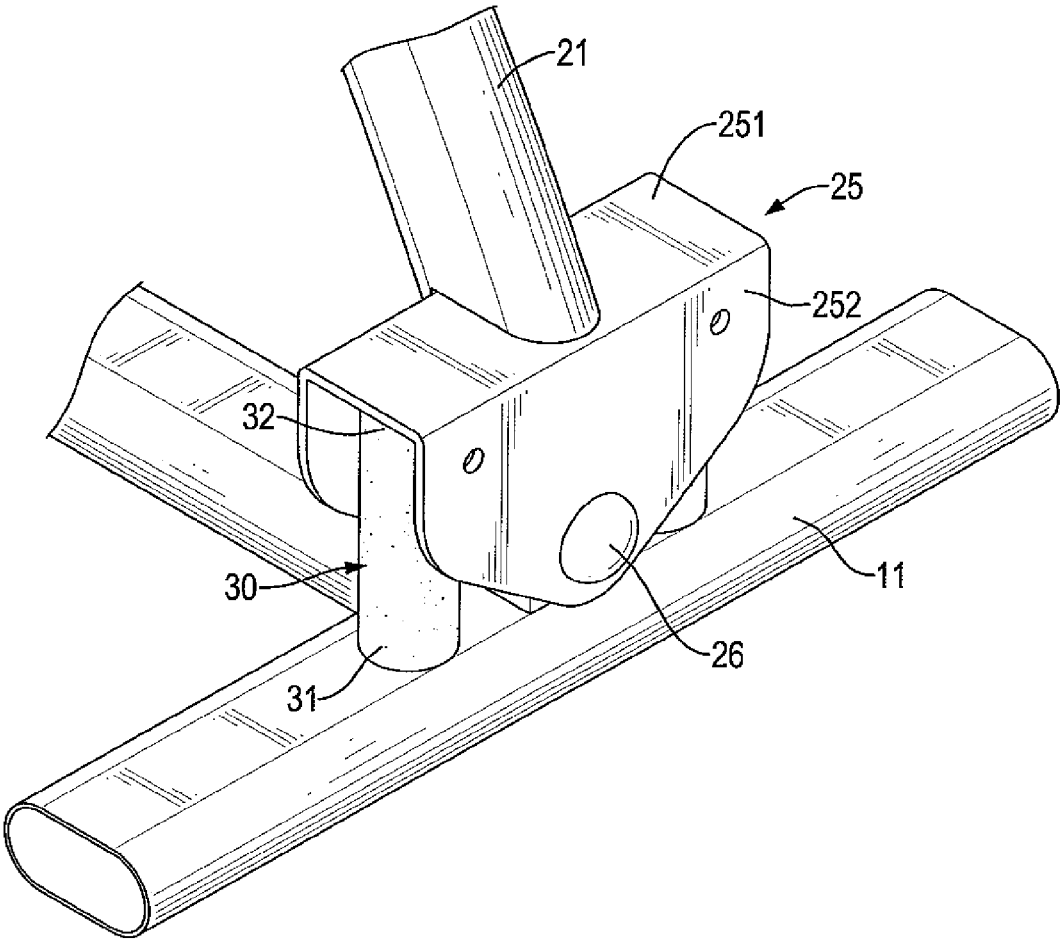
FIG. 3 is an enlarged perspective view of the swingable exercise bike in FIG. 1.

With reference to FIGS. 2 and 3, each cushion unit 30 may be an elastic cylindrical rubber, a coil spring, a damper cylinder or an elastic steel board, etc. In the first embodiment of the present invention, the cushion units 30 are elastic, are elongated cylindrical rubbers, and are respectively located at two sides of the supporting rod 111. Each cushion unit 30 has a fixed end 31 and a free end 32. The fixed end 31 of the cushion unit 30 is securely mounted on the horizontal tube 11. The free end 32 of the cushion unit 30 abuts a bottom of the seat board 251.

The cushion units 30 can be mounted on the horizontal tube 11 by threads, welding process, engaging manner, or glue, etc. Preferably, each cushion unit 30 further has a positioning component 311, and the positioning components 311 are respectively mounted on bottoms of the fixed ends 31 and inserted into the cushion holes 113.

Figure 4:
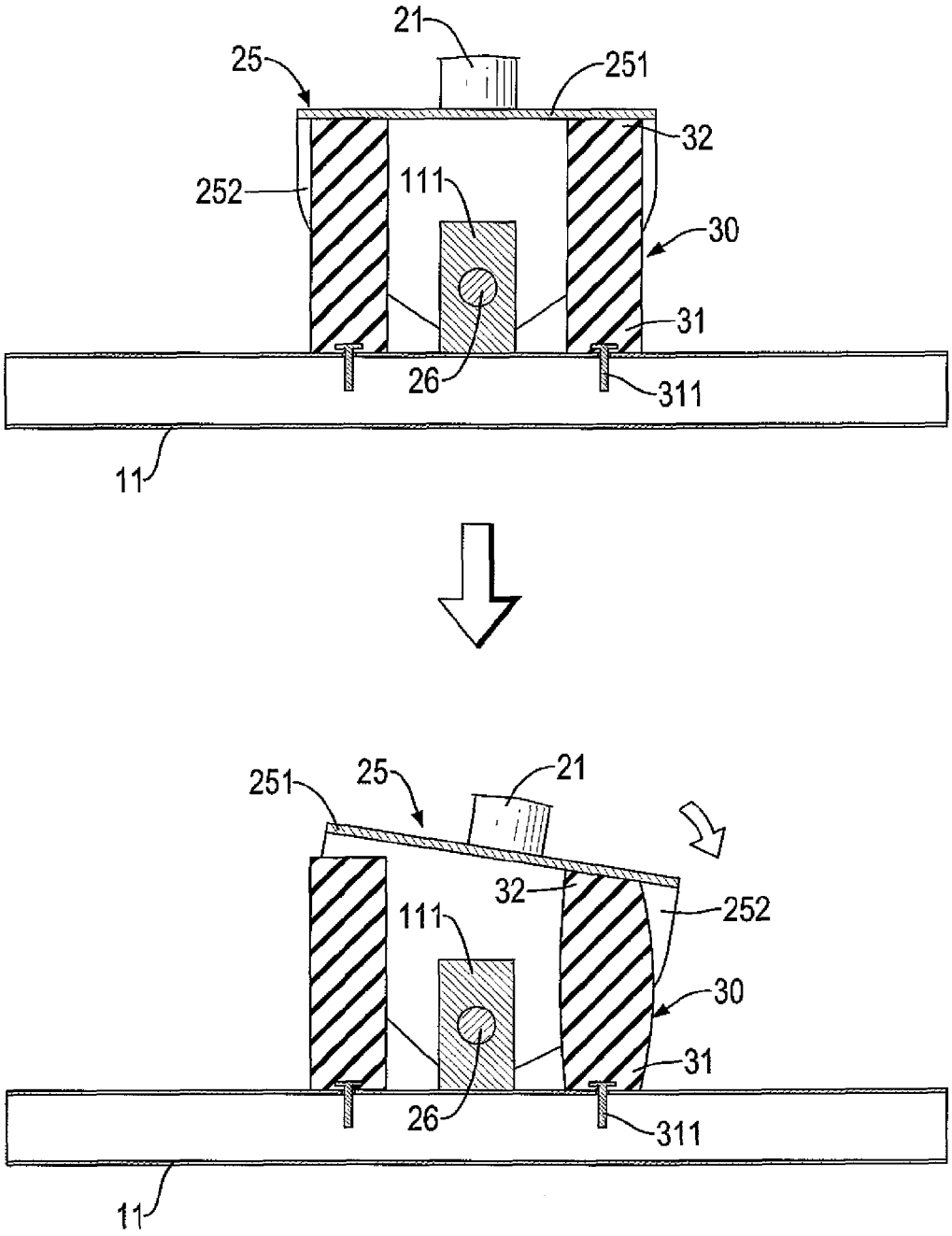
FIG. 4 shows enlarged operational front views of the swingable exercise bike in FIG. 1 in partial section.

With reference to FIGS. 1 and 4, the bike body 20 is held by the cushion units 30, and the swinging seat 25 can be swung by elasticity of the cushion units 30. When a user rides on the bike body 20 and treads the pedals 23, the body of the user swings horizontally, so the swinging seat 25 is swung horizontally and the corresponding side of the cushion unit 30 is compressed by the movement of the user. Therefore, the cushion units 30 help the bike body 20 simulate a situation of riding a real bike, and provide fun and variations during exercising. The structure of the cushion units 34 is simple, easy to install, and flexible in use.

Figure 5:
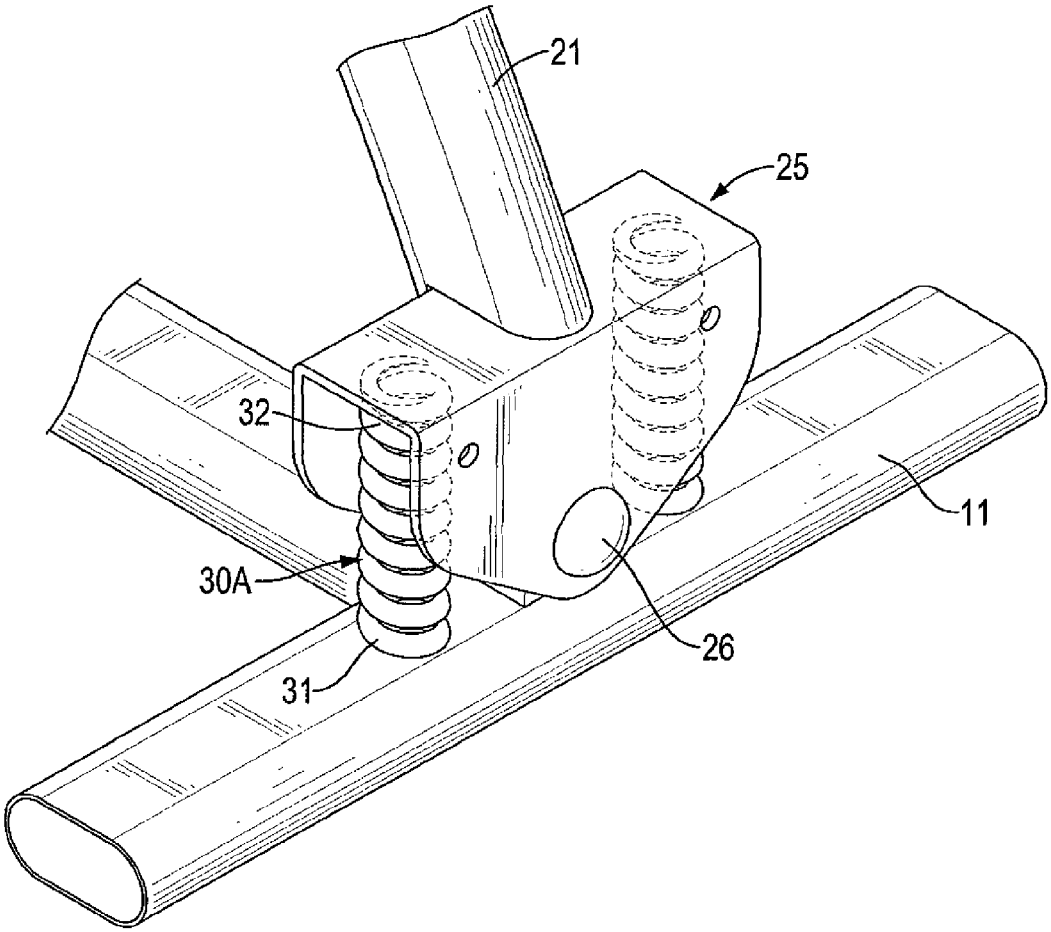
FIG. 5 is a perspective view of a second embodiment of the swingable exercise bike in accordance with the present invention.
Figure 6:
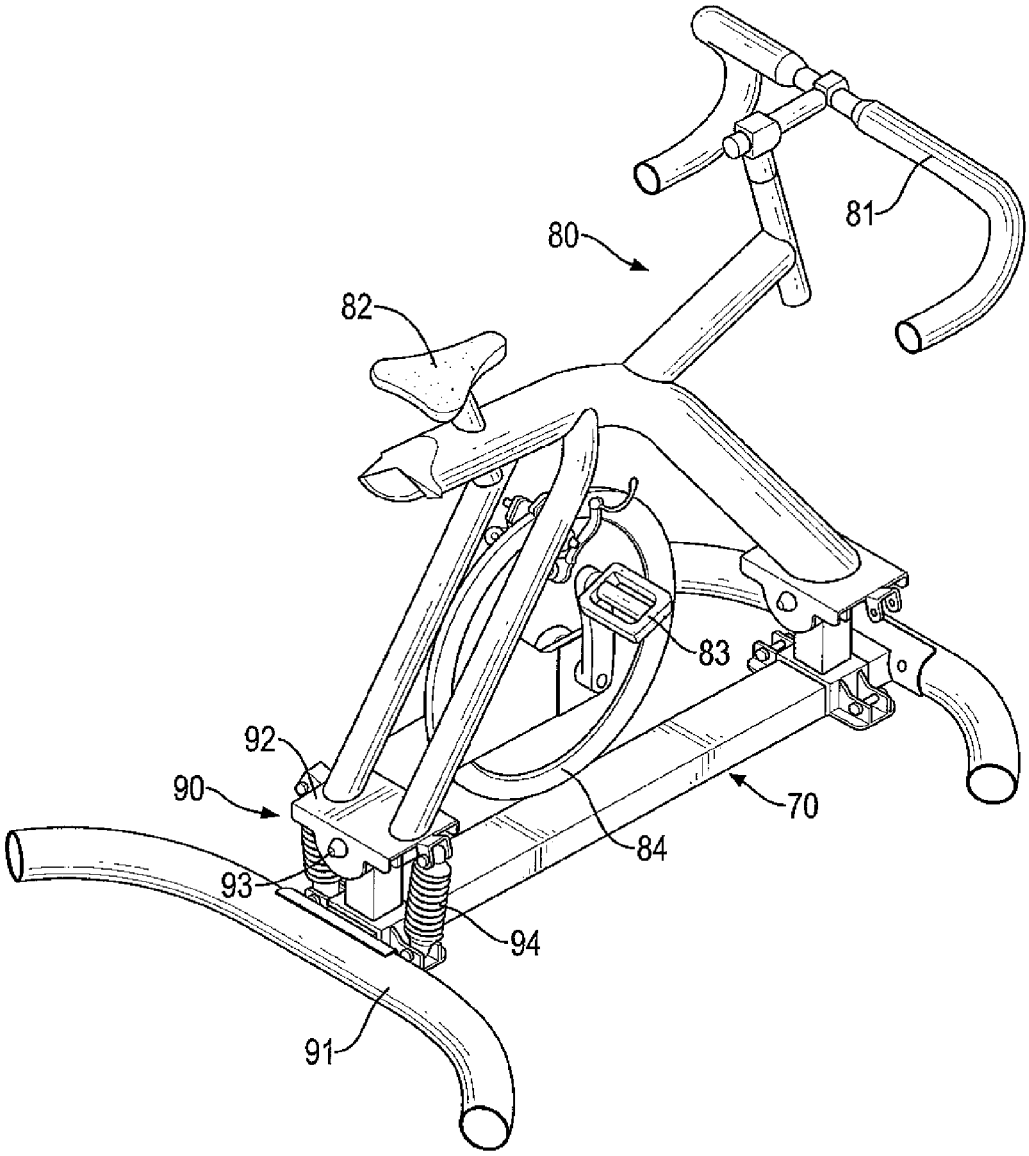
FIG.6 PRIOR ART
FIG. 6 is a perspective view of a conventional exercise bike.
Figure 7:
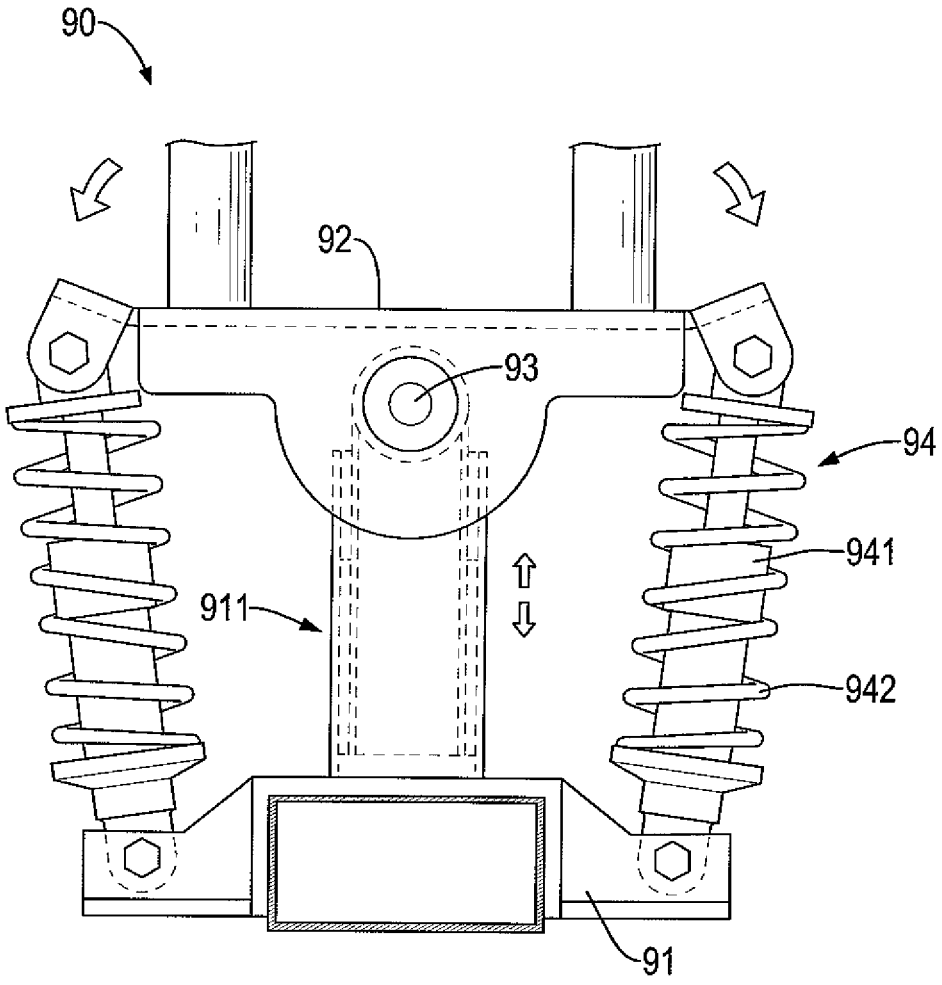
FIG.7 PRIOR ART
FIG. 7 is an enlarged operational side view of the conventional exercise bike in FIG. 6.

With reference to FIG. 5, in a second embodiment of the a swingable exercise bike in accordance with the present invention, the elements and effects of the second embodiment are same as those of the first embodiment except the cushion units 30A.

The cushion units 30A are coil springs; the fixed end 31 of the cushion units 30A are respectively welded on the horizontal tubes 11.

In additional, the fixed ends 31 of the cushion units 30A may also be securely mounted on the seat board 251 of the swinging seat 25 and the free end 32 of each of the cushion units 30A abuts a top of the horizontal tube 11.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A swingable exercise bike comprising:

a base having two horizontal tubes, each horizontal tube having a supporting rod;

a bike body pivotally connected with the base and having a bike frame having a front end and a rear end; and two swinging seats respectively and securely mounted on the front end and the rear end of the bike frame, and pivotally connected with the supporting rods by two pivot shafts; and multiple cushion units being elastic, elongated, and mounted between the horizontal tubes and the swinging seats, each cushion unit having a fixed end and a free end opposite to the fixed end.

2. The swingable exercise bike as claimed in claim 1, wherein each swinging seat has a seat board being rectangular, horizontally mounted on the bike body and having a bottom; and two supporting plates parallelly and respectively protruding downward from two horizontal edges of the seat board.

3. The swingable exercise bike as claimed in claim 2, wherein the fixed ends of the cushion units are respectively securely mounted on the horizontal tubes, and the free ends of the cushion units respectively abut the bottoms of the seat boards.

4. The swingable exercise bike as claimed in claim 3, wherein an amount of the cushion units is four, and each two of the cushion units are respectively mounted on one of the horizontal tubes and located at two sides of the supporting rod of a corresponding one of the horizontal tubes;

each horizontal tube has two cushion holes formed in the horizontal tube, and the cushion holes are respectively located at the two sides of the supporting rod of the horizontal tube; and each cushion unit further has a positioning component mounted on a bottom of the fixed end of the cushion unit, and the positioning components on the cushion units are respectively inserted into the cushion holes.

5. The swingable exercise bike as claimed in claim 2, wherein the fixed ends of the cushion units are respectively and securely mounted on the seat boards of the swinging seats and the free end of each cushion unit abuts a top of a corresponding one of the horizontal tubes.

6. The swingable exercise bike as claimed in claim 1, wherein the cushion units are elastic cylindrical rubbers.

7. The swingable exercise bike as claimed in claim 2, wherein the cushion units are elastic cylindrical rubbers.

8. The swingable exercise bike as claimed in claim 3, wherein the cushion units are elastic cylindrical rubbers.

9. The swingable exercise bike as claimed in claim 4, wherein the cushion units are elastic cylindrical rubbers.

10. The swingable exercise bike as claimed in claim 5, wherein the cushion units are elastic cylindrical rubbers.

11. The swingable exercise bike as claimed in claim 1, wherein the cushion units are coil springs.

12. The swingable exercise bike as claimed in claim 2, wherein the cushion units are coil springs.

13. The swingable exercise bike as claimed in claim 3, wherein the cushion units are coil springs.

14. The swingable exercise bike as claimed in claim 4, wherein the cushion units are coil springs.

15. The swingable exercise bike as claimed in claim 5, wherein the cushion units are coil springs.

* * * * *